US007854623B2

(12) United States Patent
Radenne et al.

(10) Patent No.: US 7,854,623 B2
(45) Date of Patent: Dec. 21, 2010

(54) ELECTRICAL CONNECTING DEVICE HAVING MATING STATE INDICATION MEANS

(75) Inventors: Jean-Pierre Radenne, Paris (FR); Frédéric Regnier, Verneuil sur Avre (FR); Claude Casses, Clevilliers (FR); Erwan Guillanton, Maintenon (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/989,375

(22) PCT Filed: Jul. 25, 2005

(86) PCT No.: PCT/EP2005/009208

§ 371 (c)(1),
(2), (4) Date: Nov. 10, 2008

(87) PCT Pub. No.: WO2007/016956

PCT Pub. Date: Feb. 15, 2007

(65) Prior Publication Data

US 2009/0156042 A1 Jun. 18, 2009

(51) Int. Cl.
*H01R 3/00* (2006.01)

(52) U.S. Cl. ..... 439/489

(58) Field of Classification Search ..... 439/489, 439/488

See application file for complete search history.

(56) References Cited

U.S. PATENT DOCUMENTS

| | | | | |
|---|---|---|---|---|
| 2,634,311 | A * | 4/1953 | Darling | 439/191 |
| 5,405,269 | A * | 4/1995 | Stupecky | 439/191 |
| 6,847,856 | B1 | 1/2005 | Bohannon | 700/115 |
| 7,244,142 | B2 * | 7/2007 | Kato | 439/489 |
| 2004/0094450 | A1 | 5/2004 | Whiteman et al. | 206/701 |

FOREIGN PATENT DOCUMENTS

| | | |
|---|---|---|
| JP | 2004-349184 | 12/2004 |
| JP | 2005-315653 | 11/2005 |
| WO | WO-00/34605 A1 | 6/2000 |

* cited by examiner

*Primary Examiner*—Phuong K Dinh
(74) *Attorney, Agent, or Firm*—Harrington & Smith

(57) ABSTRACT

This connecting device has a connector and a counterpart connector suitable to mate therewith, and at least one RFID tag attached to one of said connectors and suitable to communicate with reader, said RFID tag including an antenna. The device further includes a switch adapted to put the RFID tag either in a first communication state or in a second communication state, depending on the full or incomplete mating state of the connectors.

9 Claims, 5 Drawing Sheets

ELECTRICAL CONNECTING DEVICE HAVING MATING STATE INDICATION MEANS

BACKGROUND OF THE INVENTION

The invention relates to an electrical connecting devices and connectors. More particularly, the invention concerns electrical connecting devices for automotive vehicle.

In the manufacturing process of automotive vehicles, an incomplete mating of connectors, which may occur during an assembling step, is usually detected through a specific checking operation at the end of the car making process, or even at a later stage, during the during the use of the car, after failure of the electrical equipment.

Such a late detection has many drawbacks, in terms of cost and safety.

There is no solution to such an issue.

SUMMARY OF THE INVENTION

It is an object of the invention to provide an electrical connecting device, the full mating of which could be ensured at an early stage, by way of a quick and reliable checking operation.

Accordingly, the invention provides an electrical connecting according to claim 1.

Thanks to the invention, the full mating state of the connecting device can be easily checked as soon as both connector parts mate. The switching means provides the information on the mating state and the RFID tag allows collecting this information.

The invention will be better understood on reading the following description of one particular embodiment of the invention, given as non-limiting example.

DETAILED DESCRIPTION OF ONE PREFERRED EMBODIMENT

Figure 1:
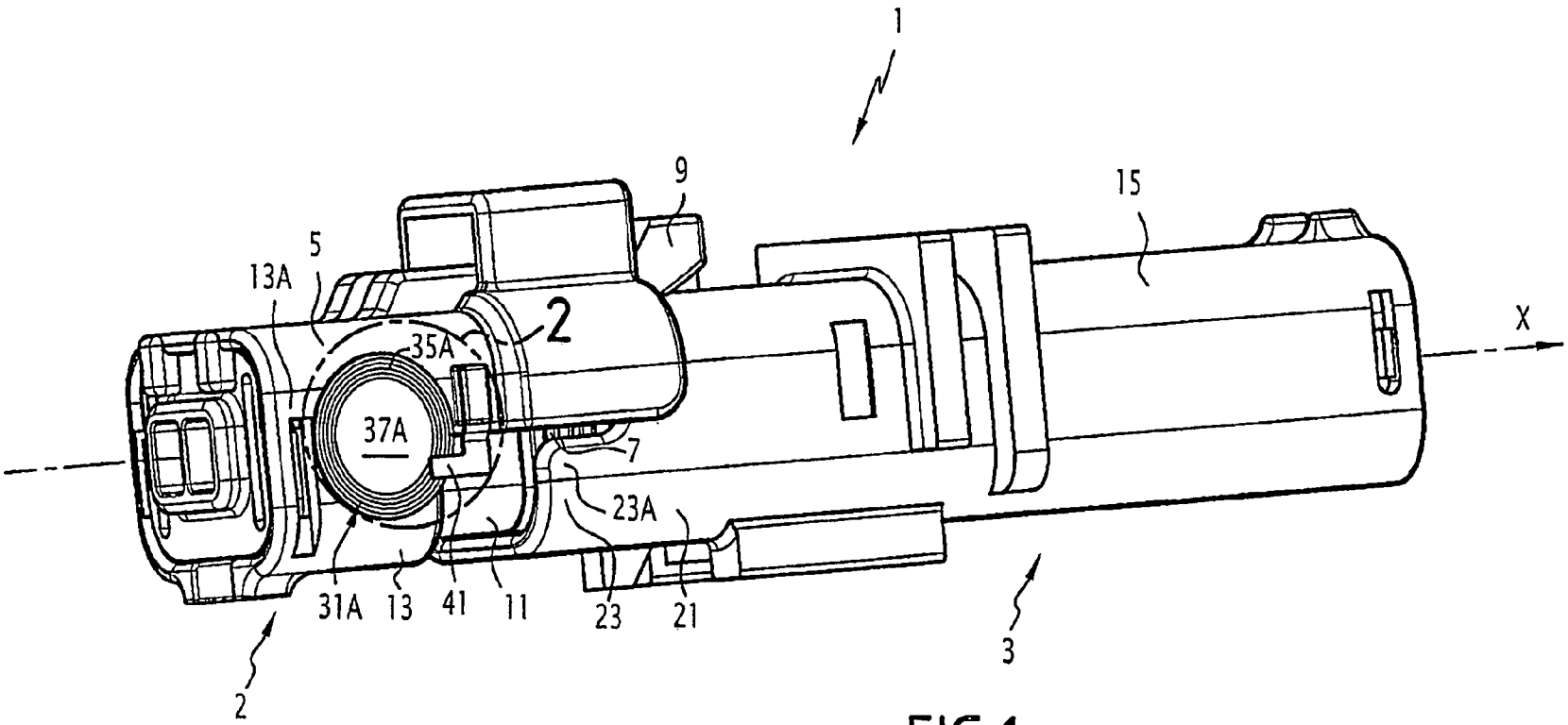
FIG. 1 is a perspective view, from one side, of an electrical connecting device of the invention, in an incomplete mating state.

A connecting device 1 according to the invention is shown on the Figures.

In the example shown, the connecting device is a two-way connecting device of a type used in an automotive application.

It comprises two complementary connectors, that is a connector 2 and a counterpart connector 3, said connectors being suitable to mate.

On the Figures, the X-axis represents the mating direction attached to the connector 2, and is oriented from the connector 2 towards the counterpart connector 3 in mating conditions.

The orientation or position terms used in the present description and related to the connector 2, in particular the terms "forward" or "front", refer to this mating axis X.

The connector 2 comprises an insulating housing 5, wherein a plurality of terminal accommodating chambers (not shown) are formed, a peripheral joint 7, and locking means 9, provided to releasably lock the connector 2 onto the counterpart connector 3.

The housing 5 has a generally parallelepipedic front inner portion 11, wherein the accommodating chambers are formed as through passages, and whereon the joint 7 is peripherally arranged.

Figure 3:
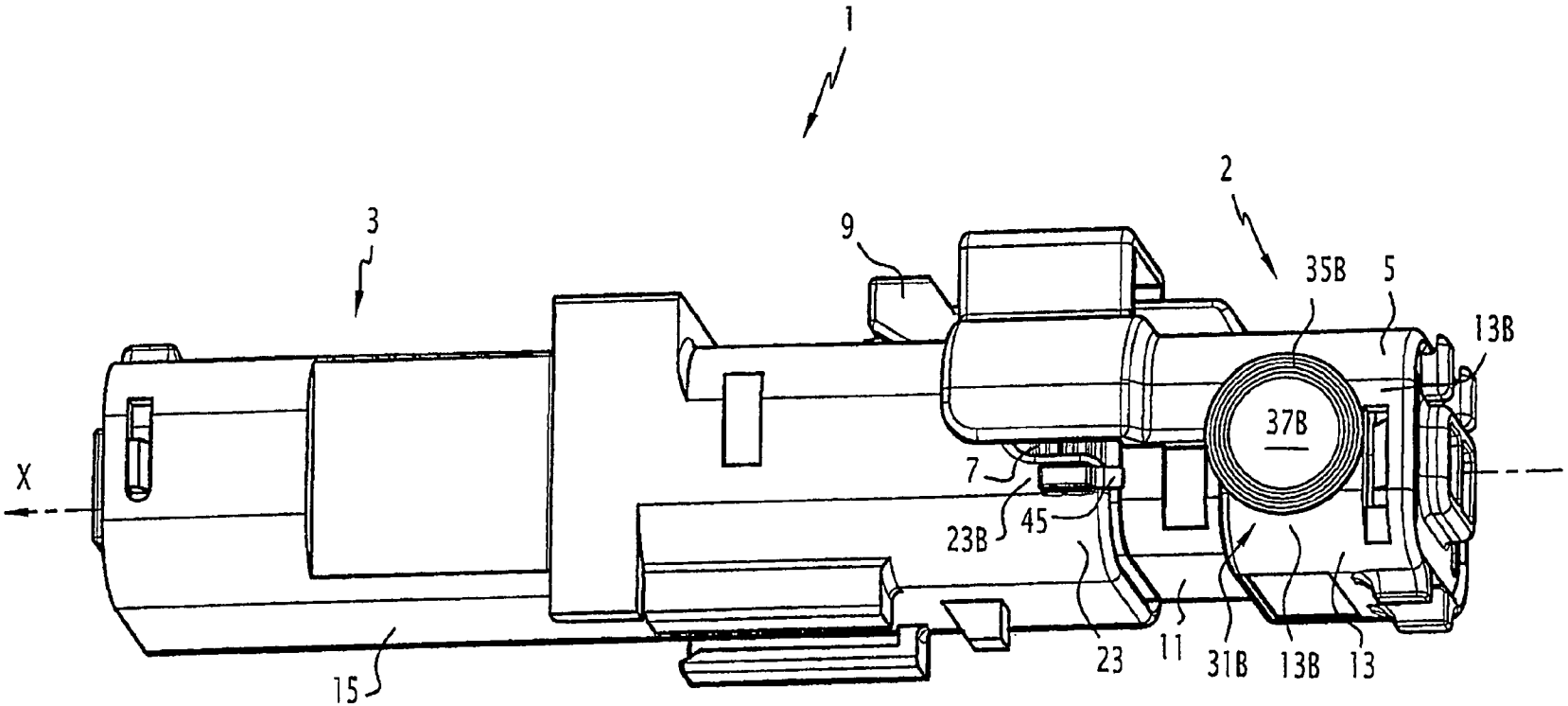
FIG. 3 is a perspective view, from the opposite side, of the electrical connecting device of FIG. 1, in the same incomplete mating state.
Figure 6:
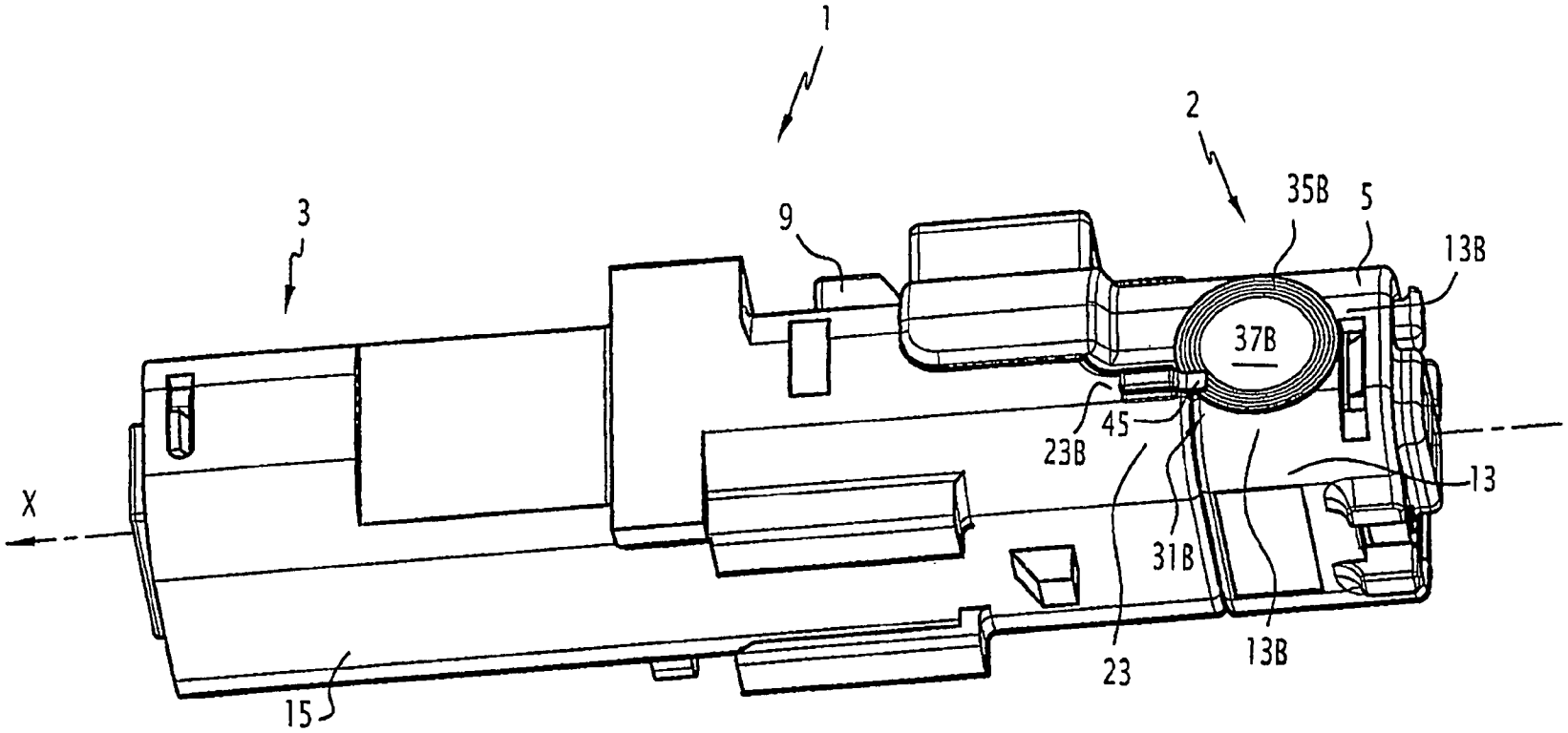
FIG. 6 is a similar view to FIG. 3, in the full mating state.

The housing 5 also has a rear peripheral portion 13, which is also generally parallelepiped-shaped, and includes two opposed lateral walls 13A (FIGS. 1 and 4), 13B (FIGS. 3 and 6).

The housing 5 is preferably integrally made of a plastic material.

Correspondingly, the counterpart connector 3 comprises an insulating housing 15 and a number of complementary terminals corresponding to the terminals of the connector 2.

The housing 15 has a front peripheral portion 21, designed to axially receive the front portion 11 of the housing 5 upon mutual mating of both connectors 2, 3.

The front peripheral portion 21 has a forwardly protruding portion 23, including two lateral walls 23A, 23B respectively corresponding to the lateral walls 13A, 13B.

Figure 4:
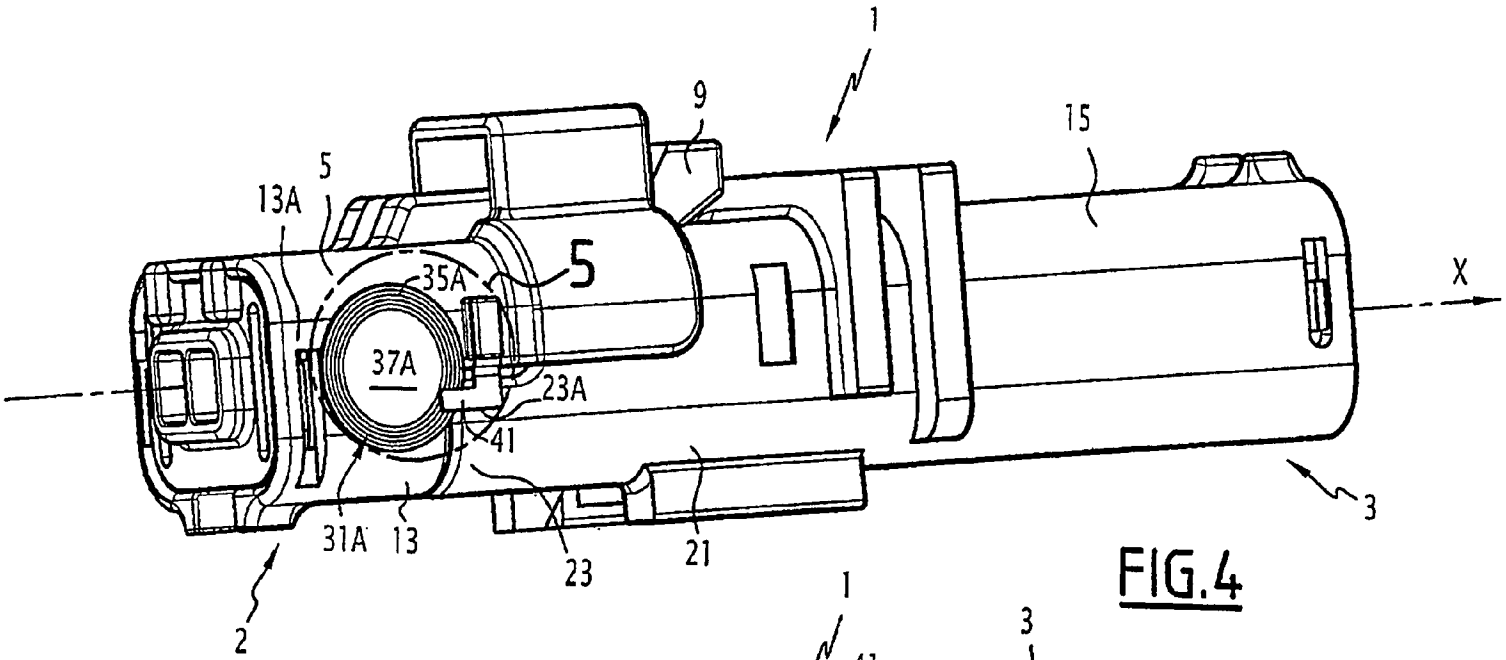
FIG. 4 is a similar view to FIG. 1, in the full mating state.

As shown for example on FIGS. 1 and 4, the connector 2 comprises a first RFID (Radio Frequency Identification) tag 31A attached on the outer surface of the lateral wall 13A, and suitable to communicate with a reader (not shown).

As shown for example on FIGS. 3 and 6, the connector 2 further comprises a second RFID tag 31B oppositely attached on the outer surface of the lateral wall 13B, and suitable to communicate with the same reader.

Each of said RFID tags 31A, 31B has an antenna 35A, 35B and a chip 37A, 37B. Both tags 31A, 31B are provided to output different identification signals, in response to an input signal from the reader.

The connector 2 is further provided with short-circuit means associated to the tag 31A.

Said short-circuit means are constituted, in the example shown, by an elastically flexible conductive blade 41, which is attached to the lateral wall 13A in the vicinity of the tag 31A.

Figure 2:
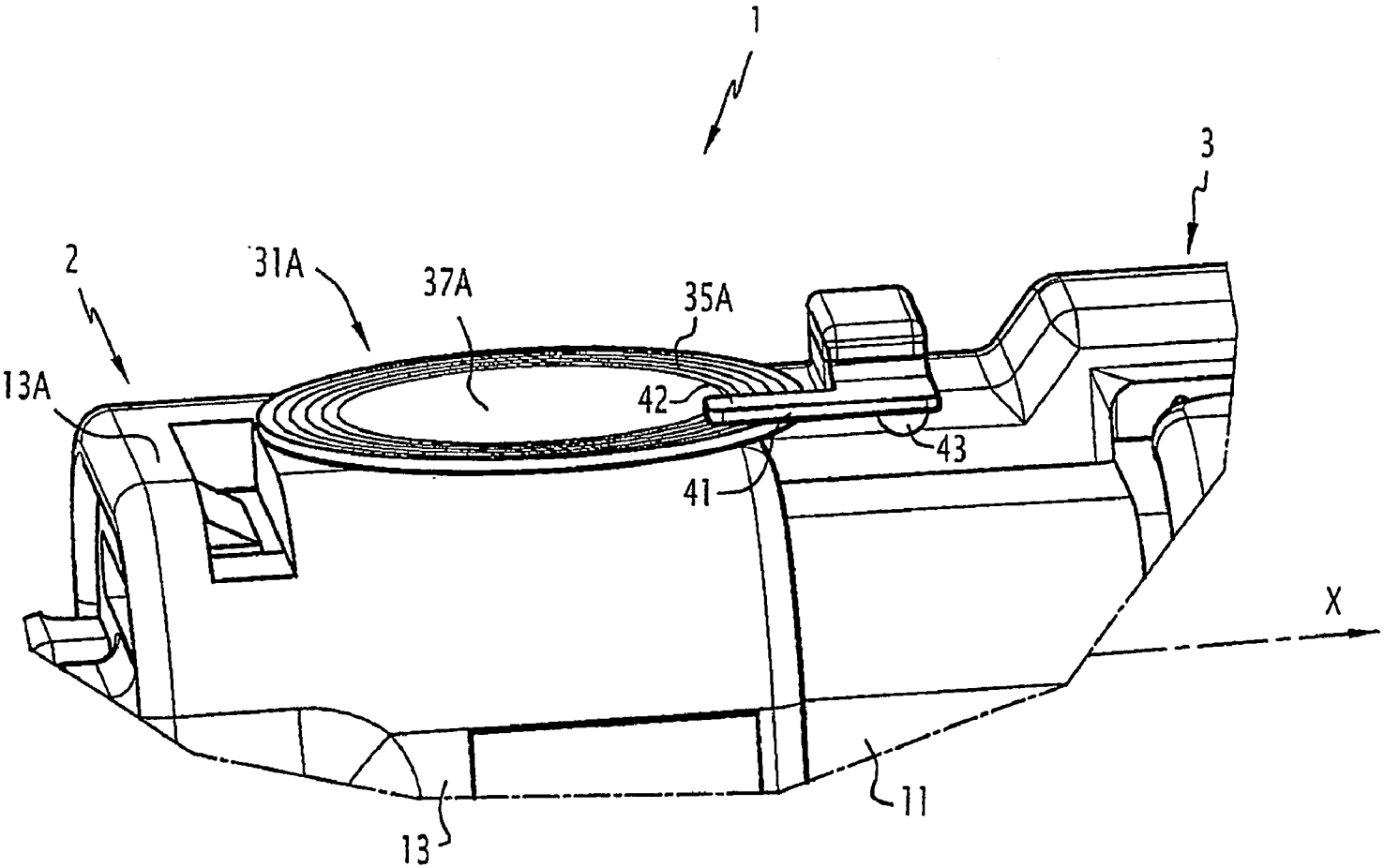
FIG. 2 is a perspective view, in another direction, of the detail area delimited on FIG. 1.
Figure 5:
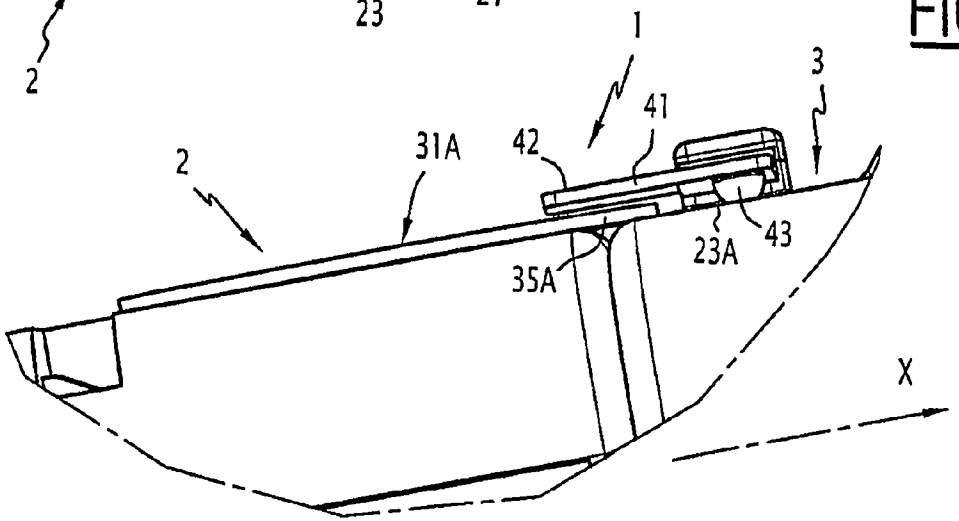
FIG. 5 is a perspective view, in another direction, of the detail area delimited on FIG. 4.

As visible on FIGS. 2 and 5, the blade 41 is formed with a rear contact portion 42 at a free end of the blade, and with a hemispherical protrusion 43 inwardly projecting from a front area of the blade.

The blade 41 is biased to a position where it contacts the antenna 35A and is urged thereon, whereby the antenna is shunted and disabled.

Thus, in incomplete mating conditions, as shown on FIGS. 1 and 2, or in no mating condition, the blade 41 is in a disabling state, whereby the communication between the tag 31A and the reader is disabled.

On the opposite lateral side of the connecting device, as apparent on FIGS. 3 and 6, the counterpart connector 3 is provided with short-circuit means associated to the tag 31B.

Said short-circuit means are constituted, in the example shown, by an elastically flexible conductive blade 45, which is attached to the lateral wall 23B and axially projects therefrom in the mating direction.

In incomplete mating conditions, as shown on FIG. 3, or in no mating condition, the blade 45 is spaced from the antenna, whereby it is in an enabling state, the antenna being not shunted, and the communication between the tag 31 and the reader being thus enabled.

As described above, in incomplete mating conditions (or in unmated conditions), the first tag 31A is in a disabled communication state, while the second tag 31B is in an enabled communication state.

Upon completion of the mating, where the locking means 9 come into engagement with complementary locking means of the counterpart connector 3, and where the complementary terminals of the connectors 2, 3 are in the full engagement state, the connectors 2, 3 come into the state illustrated on FIG. 4 to 6.

In these mating conditions, the lateral wall 23A comes into engagement with the protrusion 43, such that the blade 41 is forced out of contact from the antenna 35A and spaced apart therefrom (as especially illustrated on FIG. 5). The lateral wall 23A thus functions as an operating member, which operates the short-circuit means 41 from one state to the other.

The antenna 35A is thus brought into an enabling state where it is not shunted, whereby the tag 31A is enabled and may communicate with the reader.

Upon completion of the mating, simultaneously, the blade 45 comes into contact with the antenna 35B and is urged thereon, whereby the antenna is shunted and disabled.

In these mating conditions, the blade 45 is in a disabling state, whereby the communication between the tag 31B and the reader is disabled.

As described above, in the complete mating conditions, the second tag 31B is in a disabled communication state, while the first tag 31A is in an enabled communication state.

Upon unmating of the connectors, the sort-circuit means 41, 45 are reversely returned to their previous state, since the blade 41 is elastically biased back in contact (in shunting conditions) with the respective antenna 35A, and the blade 45 is brought away (out of contact) from the respective antenna 35B. The tags 31A, 31B are correspondingly returned to their previous state, where the first tag 31A is disabled, and the second tag is enabled.

It is clear on reading the foregoing, that the use of a suitable reader permits, depending on the enabled tag 31A, 31B, to indicate the mating state—fully mated or not—of the connectors.

Of course, the use of only one tag could be enough to discriminate both mating states, and the invention could be embodied with only one tag.

However, the use of two tags is advantageous since it ensures that, in normal functioning conditions, an identification signal is issued by one tag.

The invention described above ensures a high safety level for the electrical connections, and makes the repairing operations easier at an early stage of the manufacturing process.

Moreover, since the chips of the tags may contain identification information, the data may be computerized and analyzed in order to improve the assembling or manufacturing processes.

The invention claimed is:

1. Electrical connector assembly comprising:

a connector and a counterpart connector suitable to mate therewith, and at least one RFID tag attached to one of said connectors and suitable to communicate with a reader, said RFID tag comprising an antenna, characterized in that the assembly further comprises switching means, adapted to put the RFID tag either in a first communication state or in a second communication state, depending on the full or incomplete mating state of the connectors, wherein said switching means comprise short-circuit means, which can be either in a disabling state or in an enabling state, depending on the full or incomplete mating state of the connectors, for shunting a corresponding RFID antenna in the disabling state, whereby the communication between the RFID tag and the reader is disabled, while said short-circuit means do not shunt the corresponding antenna in the enabling state, whereby the communication between the RFID tag and the reader is enabled.

2. Electrical connector assembly according to claim 1, comprising at least two such RFID tags and respective short-circuit means, wherein one short-circuit means are in the enabling state while the other are in the disabling state, whereby only a first of the two RFID tags can communicate with a reader in the full mating state, and only the second RFID tag can communicate with a reader in the incomplete mating state.

3. Electrical connector assembly according to claim 1, wherein the short-circuit means comprise a flexible conductive blade which is urged against the corresponding antenna in the disabling state, and spaced apart from said antenna in the enabling state.

4. Electrical connector assembly according to claim 1, wherein the connector has an insulating housing, and the RFID tag is attached on said insulating housing.

5. Electrical connector assembly according to claim 4, wherein the RFID tag is attached on an outer surface of the insulating housing.

6. Electrical connector assembly according to claim 4, wherein short-circuit means associated to one RFID tag is attached on the insulating housing of the connector.

7. Electrical connector assembly according to claim 4, wherein the connector and the counterpart connector each have an insulating housing, and the insulating housing of the counterpart connector has an operating member, which is adapted to bring the short-circuit means from one state to the other upon completion of the mating of the connectors.

8. Electrical connector assembly according to claim 4, wherein the connector and the counterpart connector each have an insulating housing, and the short-circuit means associated to one RFID tag is attached on the insulating housing of the counterpart connector.

9. Electrical connector assembly comprising:

a connector and a counterpart connector suitable to mate therewith, and at least one RFID tag attached to one of said connectors and suitable to communicate with a reader, said RFID tag comprising an antenna, characterized in that the assembly further comprises a switch, adapted to put the RFID tag either in a first communication state or in a second communication state, depending on the full or incomplete mating state of the connectors, wherein said switch comprises a short-circuit, which can be either in a disabling state or in an enabling state, depending on the full or incomplete mating state of the connectors, for shunting a corresponding RFID antenna in the disabling state, whereby the communication between the RFID tag and the reader is disabled, while said short circuit does not shunt the corresponding antenna in the enabling state, whereby the communication between the RPM tag and the reader is enabled.

* * * * *

UNITED STATES PATENT AND TRADEMARK OFFICE

CERTIFICATE OF CORRECTION

PATENT NO. : 7,854,623 B2
APPLICATION NO. : 11/989375
DATED : December 21, 2010
INVENTOR(S) : Radenne et al.

It is certified that error appears in the above-identified patent and that said Letters Patent is hereby corrected as shown below:

Claim 9, col. 4, line 63 delete "RPM" and insert --RFID--.

Signed and Sealed this
First Day of March, 2011

David J. Kappos

David J. Kappos
*Director of the United States Patent and Trademark Office*